US008074403B1

(12) United States Patent
Mentnech

(10) Patent No.: US 8,074,403 B1
(45) Date of Patent: Dec. 13, 2011

(54) MOVABLE BUILDING AND MEANS THEREFOR

(76) Inventor: John Mentnech, Woodbourne, NY (US)

( * ) Notice: Subject to any disclaimer, the term of this patent is extended or adjusted under 35 U.S.C. 154(b) by 63 days.

(21) Appl. No.: 12/454,713

(22) Filed: May 21, 2009

(51) Int. Cl.
*E04B 1/343* (2006.01)
*E04B 1/38* (2006.01)

(52) U.S. Cl. ..... 52/72; 52/79.1; 52/79.9; 52/79.5; 296/26.09; 296/165; 296/171; 296/175

(58) Field of Classification Search ..... 52/79.1, 52/79.2, 79.9, 64–72, 79.5, 79.12, 79.7; 296/26.09, 296/26.1, 26.12, 26.13, 26.14, 156, 165, 296/171–172, 175–178
See application file for complete search history.

(56) References Cited

U.S. PATENT DOCUMENTS

| | | | | |
|---|---|---|---|---|
| 288,856 | A * | 11/1883 | Che | 126/107 |
| 2,155,876 | A * | 4/1939 | Stout | 52/69 |
| 3,512,315 | A * | 5/1970 | Vitalini | 52/67 |
| 4,271,644 | A * | 6/1981 | Rilliet | 52/67 |
| 4,598,506 | A | 7/1986 | Nohl et al. | |
| 4,815,152 | A | 3/1989 | MacDonald et al. | |
| 5,570,924 | A * | 11/1996 | Few et al. | 296/175 |
| 5,765,316 | A * | 6/1998 | Kavarsky | 52/67 |
| 5,971,471 | A * | 10/1999 | Gardner | 296/165 |
| 6,152,520 | A * | 11/2000 | Gardner | 296/175 |
| 6,186,692 | B1 * | 2/2001 | Hanser et al. | 403/31 |
| 6,374,433 | B1 | 4/2002 | Gray | |
| 6,604,327 | B1 | 8/2003 | Reville | |
| 7,461,480 | B1 * | 12/2008 | Gardner | 52/67 |
| 2001/0008059 | A1 * | 7/2001 | McManus et al. | 52/67 |

FOREIGN PATENT DOCUMENTS

| | | | |
|---|---|---|---|
| DE | 3334788 A | * | 4/1985 |
| FR | 2442929 A | * | 8/1980 |

* cited by examiner

*Primary Examiner* — Jeanette E. Chapman
(74) *Attorney, Agent, or Firm* — Sandra M. Kotin

(57) ABSTRACT

A full size building having three walls, an open side and a roof but no floor can be moved along parallel rails from an open free standing position to a closed position where the building abuts another structure to completely enclose an outdoor area. The building is of conventional construction but is erected over a rigid framework of iron beams. A series of roller assemblies containing rotatable axles is attached to the underside of rigid framework. The axles rest directly on the rails and rotate smoothly by means of bearings as the building moves along the rails. Stabilizers prevent wobble and keep the building on the rails when it is being moved. Locks prevent any movement when the building is in either the open or closed position. Additional locking means prevent lateral movement when the building is locked in the open position. The building can be moved using a winch and cable system or using a unique suspended sprocket wheel and track system. Concrete footings form the base for the rails. Hinged panels along the lower portion of the inside and outside of the three walls conceal the roller assemblies and stabilizers and close any space between the walls and the ground below them. The hinges enable the panels to be raised when the building is being moved. The abutting structure can be a stationary wall, an exterior wall of a stationary building, or another movable building.

30 Claims, 8 Drawing Sheets

41
42
43
44
45
46
47
48
49
50
51
52
53
55
60
61
62
63
64
A
13

MOVABLE BUILDING AND MEANS THEREFOR

FIELD OF THE INVENTION

The instant invention relates to a full size building that can be moved along parallel rails to abut another structure thereby enclosing a specific outdoor area, and the means to move the building.

BACKGROUND OF THE INVENTION

Most structures meant for human habitation are permanent and securely fixed to their sites. There are temporary structures such as tents and gazebos that can be taken down and moved, but these are not designed for long term use. Prefabricated buildings are known and are becoming more popular, but once erected, these are usually intended to be fixed to their sites and made permanent.

A review of rigid structures that can be moved reveals very limited examples which are for relatively small structures designed to cover or enclose a hot tub. Reville, in U.S. Pat. No. 6,604,327 teaches a retractable trackless spa enclosure made up of two sections, both constructed of an extruded aluminum frame, clear plastic side panels and Gambrel roof. One section is slightly smaller than the other and has a back wall. The larger front section slides over the smaller back section to nest around the back section. A pivotally mounted front wall tilts to enable the front section to move over the spa. Both sections can be moved away from the spa during good weather and can completely enclose the spa during inclement weather. This system can work well for hot tubs of varying sizes but would not work for a full sized swimming pool or for a large patio area. In U.S. Pat. No. 6,374,433, Gray discloses a movable hot tub cover structure that includes four walls and a roof. The cover structure sits on a wheeled cart which moves on high density plastic or rubber wheels over angle iron rails. The cover structure is moved by means of a garage door reversible motor activated by a remote control and utilizes a chain drive located on each transverse side. The hot tub is located at ground level and the cover structure is situated on a raised deck built contiguous with the upper level of the hot tub. The cover structure can completely cover the hot tub or be completely removed from the hot tub. The patent describes the walls as being from three to seven feet high and the sides from ten to thirty feet long. This structure may work well for covering a hot tub, but would not be practical to cover a large outdoor area. If the system described and illustrated were to be thirty feet long it would have to be constructed of a very light plastic.

Structures have been designed to cover full sized swimming pools and these range from fabric covered steel frames to permanent structures, often having one or more walls of windows or sliding doors that can be opened in good weather and closed during inclement weather. Other means have been developed to cover swimming pools, but these do not represent structures, merely covering means. See U.S. Pat. No. 4,815,152 to Mac Donald et al. An interesting permanent pool covering structure is taught by Nohl et al. in U.S. Pat. No. 4,598,506. There is a movable floor supported by four upright columns. The floor can be lowered forming a usable floor space that completely covers the pool, and can be raised to form a second ceiling when the pool is to be used.

There is a need for a rigid structure that can completely enclose an outdoor area such as a swimming pool during inclement or cold weather while being movable to the extent that the outdoor area is completely uncovered and exposed during warm weather. There is a need for a structure that, though quite large, can be moved easily, either to cover the desired area or uncover it, without the need for cumbersome machinery or complex systems. There is a need for such a movable structure for home and recreational use as well as for use in commercial settings.

BRIEF SUMMARY OF THE INVENTION

The present invention provides a building that can be moved to abut another structure thereby completely enclosing an outdoor area and sealing that area against the elements. The building is of conventional construction and can include windows and at least one door. Permanently installed rails, unique roller assemblies, stabilizers and a choice of moving systems enable the building to be moved with relative ease.

It is an object of the present invention to provide a building that can be moved easily to abut another structure thereby completely enclosing an outdoor area.

It is another object of the present invention to have a conventionally constructed building having three walls, a roof, one open side and no floor that can be easily moved along a rail system.

Another object of the present invention is to provide a strong rigid framework enabling the building to be moved with no adverse effects on any of its supports, parts or assemblies.

It is a further object of the present invention to provide a moving system that can be activated quickly with little effort on the part of the operator.

It is another object of the present invention to have the movable building sealable against another structure so that the resulting enclosure is completely weatherproof.

A still further object of the present invention it to provide stabilizing means so that the building does not sway or come off the moving system when being moved or under extreme weather conditions.

It is also an object of the present invention to provide a locking system so that the building cannot move once set in place.

The invention is a free standing movable building that comprises a rigid framework comprising iron members permanently and securely affixed one to the other to form a strong, stable and rigid infrastructure functioning as a single unit and remaining intact when the building is moved, the iron members including two opposing longitudinal base beams and one rear transverse base beam forming a U-shaped foundation for said movable building and providing a low center of gravity and stability therefor, two front vertical support beams affixed to the front end of each longitudinal base beam, two rear vertical support beams affixed to the rear end of each longitudinal base beam, an upper horizontal beam affixed to the tops of the two front vertical support beams, and an upper horizontal beam affixed to the tops of the two rear vertical support beams. There are also three contiguous walls including a rear wall and two side walls, and a roof built over the rigid framework, an open front portion and no floor, and a plurality of opposing pairs of roller assemblies to move the building from a first location to a second location. The roller assemblies are affixed to the undersides of the longitudinal base beams of the rigid framework.

The invention also includes a structural assembly for reversibly enclosing an outdoor ground area that comprises a free standing movable building configured to be moved in its entirety from a first location adjacent the outdoor ground area to a second location enclosing the outdoor ground area, the building having three contiguous walls, in the form of two side walls and a rear wall, an open side being the forward portion of the building, a roof and there being no floor, parallel rail assemblies, set on the ground on either side of the outdoor ground area, on which the building moves, means to move roll and propel the building over said parallel rails from the first location in a rearward direction to enclose the outdoor ground area and from the second direction to expose the outdoor ground area, and an abutting structure against which the building is moved to completely enclose the outdoor ground area and to cover the open side of the building.

Another form of the invention is a structural assembly for reversibly enclosing an outdoor ground area that comprises a free standing movable building configured to be moved in its entirety from a first location adjacent the outdoor ground area to a second location enclosing the outdoor ground area, the building having three contiguous walls in the form of a rear wall and two side walls, an open side being the forward portion of the building, a roof and there being no floor, the building having a rigid framework. There are a plurality of rotatable solid axle roller assemblies affixed to the undersides of the rigid framework enabling the building to move from the first location in a forward direction and from the second location in a rearward direction, parallel rail assemblies, set on the ground on either side of the outdoor ground area, on which the building moves, propelling means to propel the building on the rail assemblies, and an abutting structure against which the building is moved to enclose the outdoor ground area and to cover the open side of the building.

Other features and advantages of the invention will be seen from the following description and drawings.

DETAILED DESCRIPTION OF THE INVENTION

The present invention may be a movable full sized building. The invention may be made up of three essential components, the building itself, the means to move the building and an abutting structure. All three of these components may be needed for the invention to perform properly and to completely enclose an outdoor area.

The building 40 of the present invention, seen in FIGS. 1 through 9, may be constructed of conventional building materials which may include but are not limited to 2×4 or 4×6 studs, plywood panels, windows, doors, trusses, roofing materials, exterior paneling, siding, insulation and interior paneling. The skeleton or framework 41 of the building 40 may be unique as well as the fact that the building may have only three walls, one completely open side, a roof, and no floor.

Figures 10, 11, 12, 13, 14:
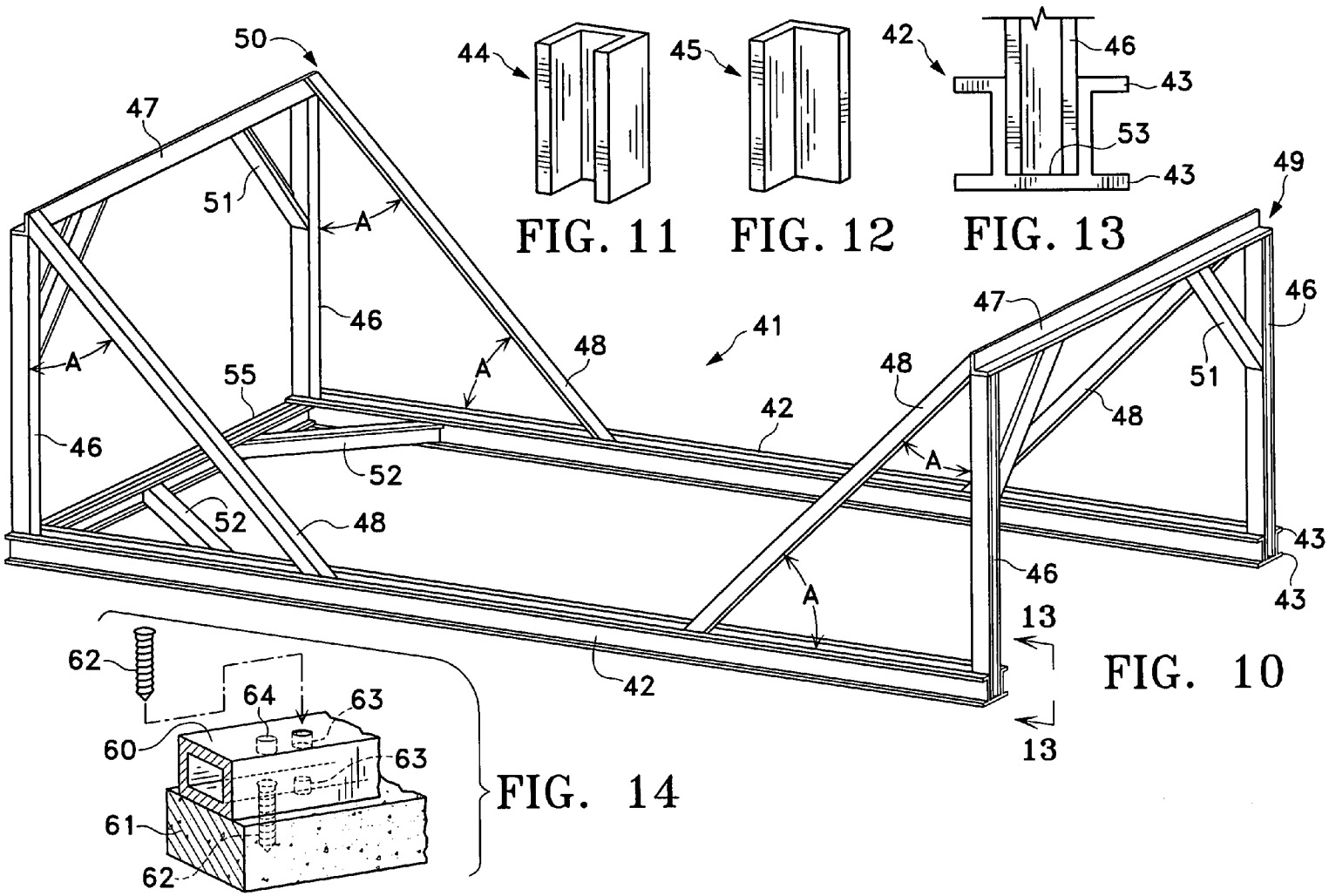
FIG. 10 is a front perspective view of the iron framework of the movable building.
FIG. 11 is a perspective view of a section of a channel iron beam.
FIG. 12 is a perspective view of a section of an angle iron beam.
FIG. 13 is a close-up front view of the lower front portion of the iron framework of FIG. 10.
FIG. 14 is a front perspective view of one end of the stationary rail and concrete footing.

The framework 41 of the building 40, seen in FIG. 10, may be composed of three differently configured iron beams. The base beams 42 and 55 may be channel iron in the shape of a U, with horizontal extensions 43 from both the top and bottom edges. A base beam 42 can be seen in cross section in FIG. 13. The four corner vertical support beams may be the more common form of channel iron 44 as seen in FIGS. 11 and 13. The remaining parts of the framework, the upper horizontal beams and cross support beams, may be constructed of angle iron 45 which is illustrated in FIG. 12. All parts of the iron framework 41 may be welded together to form a strong, stable and rigid infrastructure for the movable building 40. The joining of the individual parts of the iron framework 41 by welding may insure that all joints remain completely intact when the building is moved.

The base of the movable building 40 may be the most important part of the framework 41. The base may consist of three base beams 42 and 55, two longitudinal base beams 42 which may form the foundation for the two side walls, and one transverse or rear base beam 55 which may form the foundation for the rear wall. The unique structure of the base beams 42 an 55 not only may provide added strength and support, but the horizontal extensions 43 may provide attachment and support surfaces as will be discussed below. The weight of the base beams 42 and 55 may provide a low center of gravity which may contribute to the stability of the finished structure.

There may be four vertical support beams 46, one set into each end of the two longitudinal base beams 42 and disposed at each of the four corners of the framework 41. These may be seen in FIGS. 10 and 13. An upper horizontal support beam 47 may extend across the tops of the two front vertical support beams 46 and another upper horizontal support beam 47 may extend across the tops of the two rear vertical support beams 46.

To further stabilize the framework 41 cross supports may be placed at strategic points. There may be one long cross support 48 extending from each front upper corner 49 rearwardly and downwardly to a longitudinal base beam 42 and one long cross support 48 extending from each rear upper corner 50 forwardly and downwardly to a longitudinal base beam 42. Each of these four long cross supports 48 may form a 45° angle (angle A) with the vertical support beams 46 and with the longitudinal base beams 42. There may be two upper short cross supports 51, each extending from the front upper horizontal support beam 47 to a front vertical support beam 46 and two upper short cross supports 51, each extending from the rear upper horizontal support beam 47 to a rear vertical support beam 46. None of the aforementioned support beams or cross supports may be visible when the building is completed. There may also be two lower short cross supports 52 located at the lower rear corners of the building, one extending from the rear base beam 55 to the right longitudinal base beam 42 and the other from the rear base beam 55 to the left longitudinal base beam 42. These two lower short cross supports 52 may lie close to the lower rear corners and may be the only members of the iron framework 41 visible in the completed building since there may be no floor to cover them. However, they may be covered by materials used in construction of the interior of the building.

The U portion or channel 53 in the base beams 42 and 55 may be sized to accommodate the vertical studs 54 used in the construction of the movable building 40. If a 2×4 (actual measurement 1.5×3.5 in) is to be used the width of the channel 53 may be 3.5 in (8.9 cm) and if a 2×6 (actual measurement 1.5×5.5) is to be used the width of the channel 53 may be 5.5 in (14.0 cm). In construction, the studs 54 may be appropriately spaced along the two longitudinal sides and the rear of the framework 41 and set into the channel 53 of the base beams 42 and 55. A metal brace (not illustrated) may be placed across the upper extensions 43 of the base beams 42 and 55 adjacent to each stud as the studs are set in place. These metal braces may stabilize the studs 54 and keep them in place during construction and may insure their stability when the building 40 is being moved.

The remaining construction of the movable building 40 may be substantially conventional. However, since the movable building 40 must be able to be moved smoothly and within the confines of the chosen methods of moving it, the overall finished weight must be carefully considered. This consideration may dictate the number and placement of windows and type of windows to be used, the number and placement of doors and the type of roofing and exterior siding selected. Additionally, since the interior of the building 40 will be exposed to the elements for a portion of the year, the use of conventional dry wall should be avoided. A water proof paneling may be a better choice. Some wood paneling may work well for the interior walls, and sealing finishes may also be applied to the wood paneling. The interior rafters may be exposed, or a ceiling may be added. It may be prudent to use materials developed to prevent moisture build-up and to deter mold formation especially in the upper areas. If the building is to be erected to enclose a swimming pool, all of the interior construction should be selected to minimize moisture damage. A rain curtain may be attached over the open front of the building to minimize excessive water damage when the building is free standing. Such rain curtains are will know in the art.

Figure 21:
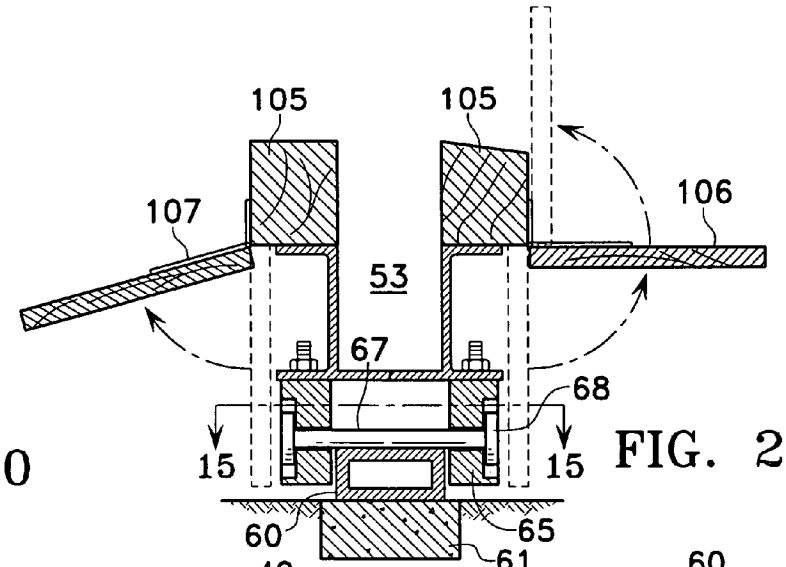
FIG. 21 is a cross section through line 21-21 of FIGS. 5 and 6 showing the side panels raised.
Figure 20:
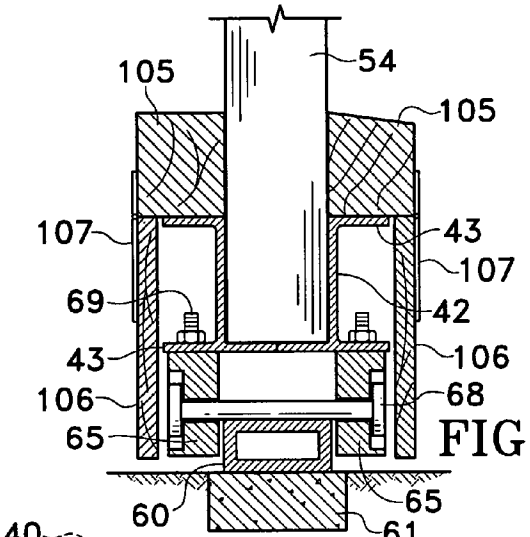
FIG. 20 is a cross section through line 20-20 of FIG. 4 showing the side panels lowered.

The movable building 40 may be moved over two carefully positioned parallel rails 60. Before the rails are put into place, concrete footings 61 must be laid. It may be critical that the site selected for the movable building 40 be level. If the ground is not level, grading may be necessary before the footings are poured. The dimensions of the movable building 40 must be determined before any construction takes place since the two parallel rails 60 must be set down at the same width chosen for the two longitudinal base beams 42. The rails may be at least twice the length of the longitudinal base beams 42, but they may also be longer. The location of the rails 60 may be marked and trenches for the footings 61 dug out and bordered. The concrete footings 61 may be at least six (6) inches (15.2 cm) thick, run the full length of the rails 60 and may be wider than the width of the rails so that they may provide a substantial base. See FIGS. 14, 20 and 21. The long concrete footings 61 must be continuous and may extend an inch or two beyond the rails 60 at each end.

Once the footings 61 have been poured and allowed to set, the rails 60 may be positioned. The rails 60 may be made up of sections of hollow channel iron. The sections may be set onto the footings 61, welded together, and the ends cut as necessary to fit the desired length. The welds may thereafter be carefully smoothed to form two level tracks over which the movable building 40 can be propelled. The rails 60 may be attached to the concrete footings 61 by anchor bolts 62 screwed directly into the concrete. Beginning close to the ends of the rails 60, and continuing approximately every two feet (0.61 m) along the length of the rails, openings 63 may be drilled through the iron rails 60 using a masonry bit or other such means. The openings 63 may go through both the top and bottom layers of the channel iron rails 60 and may be made in adjacent pairs along the length of the rails 60. An anchor bolt 62 may be threaded downward through the openings 63 and screwed into the concrete footing to the extent that the top of each anchor bolt 62 may be even with the bottom layer of the rail 60. Each anchor bolt 62 may be sunk at least 3.5 inches (8.9 cm) into the concrete. Once an anchor bolt 62 has been secured into each opening 63, plugs 64 maybe welded into the openings 63 in the upper layer of the iron rail so that all openings may be filled in across the top surface of each rail 60. The plugs 64 and welds may thereafter be smoothed over so the rails 60 offer a smooth surface over which the movable building 40 may traverse. These features may be seen in FIG. 14.

Since the movable building 40 may have no floor, it may be important to properly prepare the surface between the two parallel rails 60. This may best be accomplished before the building is constructed. The surface between the rails may function as the floor of the building, both in the open and in the closed orientation. This surface area may be at least twice the length of the building and extend the full width of the building between the rails. The area may be paved using concrete or other paving material. It may be completely weather proof and set down to withstand freezing and thawing if used in colder climates. If the building is to be constructed to enclose a swimming pool, the area around the pool and extending into the open building may be paved. or otherwise suitably prepared.

Figure 15:
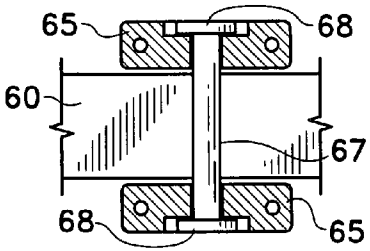
FIG. 15 is a top plan view of the a roller assembly.
Figure 17:
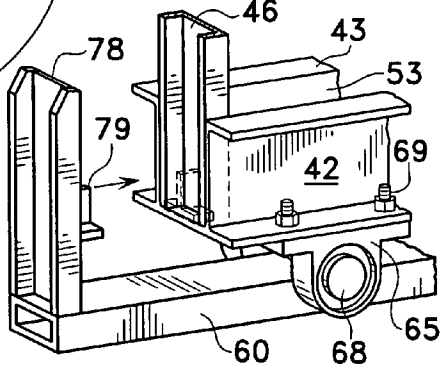
FIG. 17 is a perspective view of the rear lock.
Figure 19:
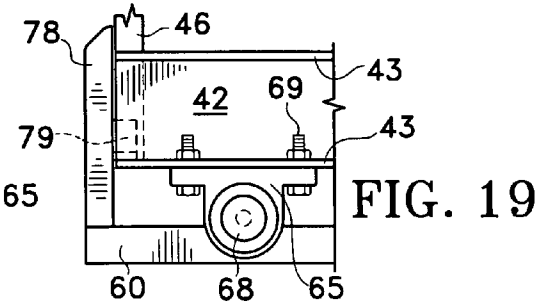
FIG. 19 is a side view of the rear lock in closed position.

The movable building 40 may move over the rails 60 on a series of roller assemblies. Each roller assembly may be composed of an axle or solid roller 67 connected between two supports 68. Both supports 68 may contain interior bearings which may assist the solid roller 67 to rotate, thereby enabling the building to move smoothly over the rails. Each support 68 may be held securely in place by a heavy iron bracket 65. See FIG. 15. Thus there may be two iron brackets 65 for each roller assembly. The two brackets 65 may be fastened to the undersides of the lower horizontal extensions 43, one on the inside and one on the outside, of the longitudinal base beams 42. Bolts 69 set through holes drilled in the lower horizontal extensions 43 may secure the brackets 65 in place. The roller assemblies may be affixed beginning at each end of the two longitudinal base beams 42 and may be regularly spaced along the entire lengths of the longitudinal base beams 42. The roller assemblies may be similarly arranged on each side of the building forming pairs of roller assemblies, each member being directly opposite to the other along the lengths of the two longitudinal base beams 42.

Figure 16:
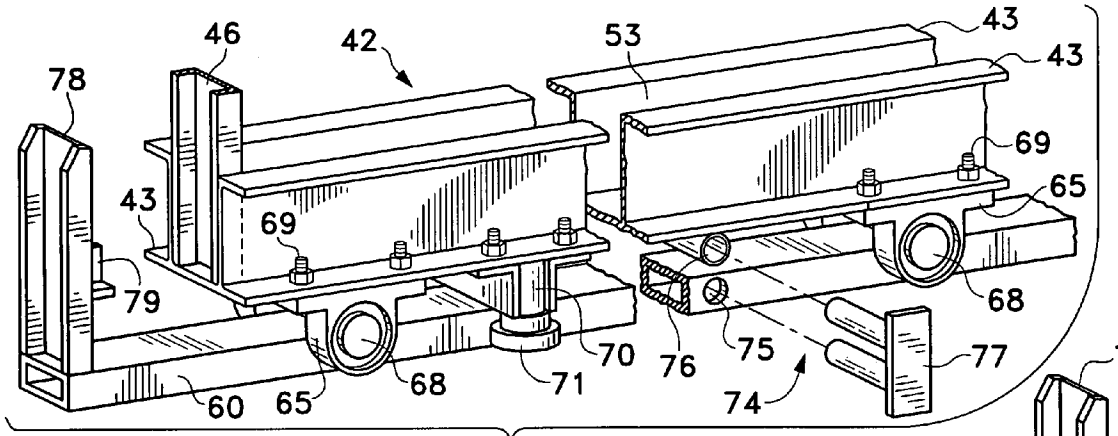
FIG. 16 is a perspective view of the stationery rail and transport system.
Figure 18:
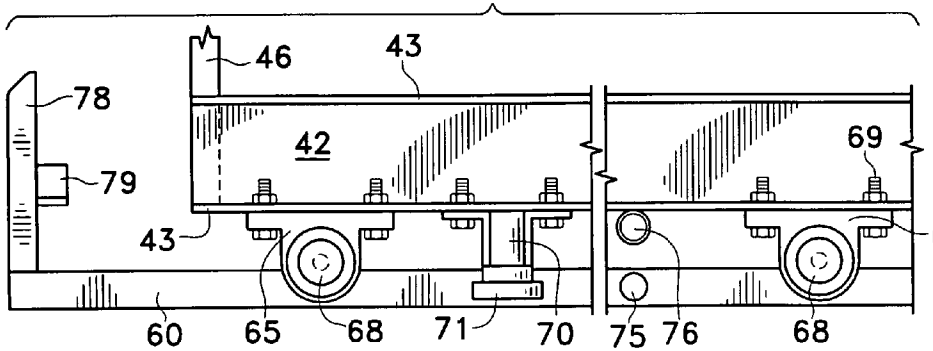
FIG. 18 is a side view of the stationary rail and transport system.

To provide added stability and prevent wobble when the building is being moved, a series of additional supports 70 may be attached to the underside of the longitudinal base beams 42 adjacent to each of the end roller assemblies and in one or more additional locations along the longitudinal base beams 42. These supports 70 may also be attached by means of bolts 69 set into holes in the lower horizontal extensions 43 and may extend across the longitudinal base beam 42. There may be a horizontally oriented iron rotating wheel 71 set into each side of the support 70 and spaced so that there may be a rotating wheel 71 abutting the inner and outer side surfaces of the rail 60. These wheels 71 may be horizontally oriented to provide support without creating any drag when the building is being moved. The roller assemblies and supports 70 may be seen in FIGS. 16 and 18.

Once the movable building 40 has been moved to its desired location, it may be fixed in position to prevent unintentional movement. A side lock assembly 74 may be provided which may lock the building in place when it is in the completely open position (situated at the far end of the rails 60) and also after being moved to the fully closed position (adjacent to the abutting structure). There may be at least one side lock assembly 74 on each side of the building. A section of iron pipe 76 may be welded to the underside of each longitudinal base beam 42 such that the open end of the iron pipe faces outward. An opening 75 may be drilled through the side walls of each rail 60 at a point that would lie directly under the open end of the pipe 76 when the building is at its fully opened position and another opening 75 drilled into the side walls of each rail 60 at a point that would lie directly under the open end of the pipe 76 when the building is at its fully closed position. A lock member 77 may be composed of an iron plate with two parallel iron dowels extending from one face, the iron dowels spaced to cooperate with the opening 75 in the rail and the open end of the pipe 76. When the locking member 77 is inserted into these two openings on each side of the building 40, the building 40 may be restrained from any movement. See FIGS. 16 and 18.

When the building is in its fully closed position, it may abut a wall or other structure which may provide additional stability and prevent movement or wobble. However, when the building is fully opened, it may stand on its own, on the rails, and may exhibit some wobble or lateral movement in high winds, even when locked in place. To minimize this occurrence, a rear lock may be provided. An iron upright 78, such as a section of channel iron 44, may be welded to the rear end of each rail 60 so that the flat surfaces of the uprights 78 face forward. An L-shaped locking member 79 may be welded to the flat surface of each upright 78 at a specific level so that the locking member 79 may cooperate with the channel in each rear vertical support beam 46 and may just rest on the bottom of the U-shaped channel 53 in the longitudinal base beam 42 when the building 40 is moved to its rearmost position. The two rear locks may add sufficient stability to the free standing building 40 to prevent sway or wobble in high winds. The rear lock may be seen in FIGS. 16 through 19.

Though the movable building 40 of the instant invention may carry considerable weight, it may be moved quite easily over the rails 60. Two moving means are described herein, but may not be considered limiting as to the means by which the building may be moved.

A winch 80 may be used to move the building, either hand cranked or motorized. A reversible motor may be used so the drum of the winch may be rotated both clockwise and counterclockwise. The winch 80 may be welded or otherwise attached to the center of the rear base beam 55 of the iron framework 41. The winch 80 may not be seen from within the building and may be concealed by an enclosure or housing 81 extending from the exterior rear wall of the building. There may be a rope or cable 82 affixed to the drum of the winch 80. The cable 82 may be at least twice the length of the building 40 and may have a hook 83 attached to its free end. An iron ring or loop 84 may be set into the ground at a midpoint between the rails 60 at each end of the rail system.

Figure 23:
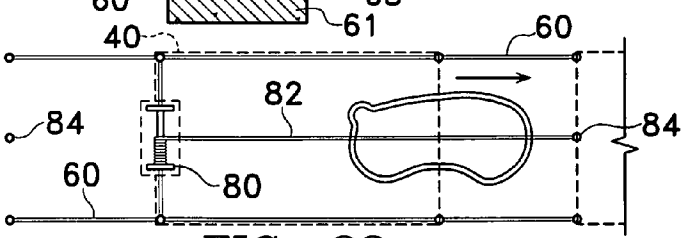
FIG. 23 is a top plan view of the movable building in a partially closed position.
Figure 22:
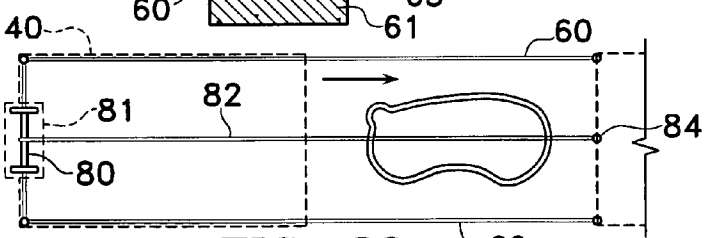
FIG. 22 is a top plan view of the open position of the movable building and the cable set for moving the building toward the closed position.
Figure 24:
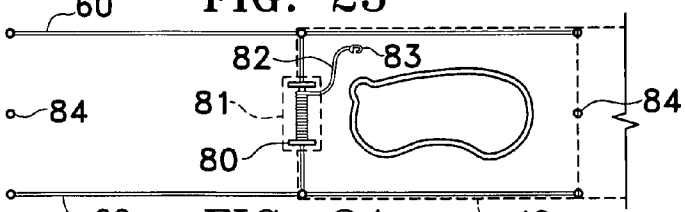
FIG. 24 is a top plan view of the movable building in the completely closed position and the cable hook detached from the ground loop.
Figure 25:
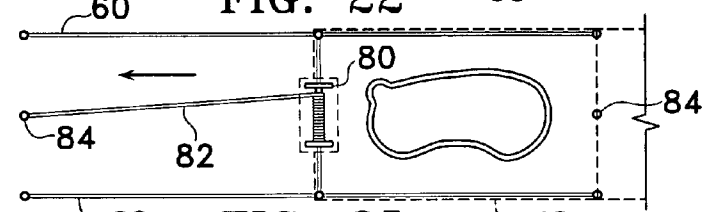
FIG. 25 is a top plan view of the movable building in closed position with the cable hook in engagement with the rear ground loop ready to move the building to the open position.

To move the building 40 from its fully opened (rear) position to enclose the outdoor area the cable 82 may be unwound from the drum and stretched out until the hook 83 cooperates with the loop 84 at the opposite end (front) as seen in FIG. 22. The locking member 77 may be removed from each side of the building and the winch 80 may be activated, either by means of a hand crank or a motor. As the cable 82 is wound onto the drum, the building 40 may be moved forward as seen in FIG. 23. When the building 40 reaches the forward most end of the rails 60 it may abut an abutting structure to completely enclose the surface now covered by the building 40. The hook 83 may be removed from the loop 84 and the cable 82 rewound onto the drum of the winch 80. See FIG. 24. The locking member 77 may be inserted into the forward lock opening to secure the building in the closed position and fix it in place. To open the building, or move it rearward, the locking member 77 may be removed and the cable 82 let out behind the building and connected to the rear in-ground loop 84. The winch 80 may now be activated to rotate the drum in the opposite direction, the cable 82 may be wound onto the drum and the building may be moved rearward until it reaches its rearmost position. See FIG. 25. At this time the locking member 77 may be put in place, the hook 83 removed from the loop 84, and the cable 82 fully wound onto the drum. As the building reaches its rearmost position, the L-shaped locking members 79 on the rear ends of the rails 60 may communicate with the channels in the rear vertical support beams 46 and longitudinal base beams 42 to further support the now free standing building 40.

The building 40 may also be moved by means of a unique motorized drive system. The driving mechanism for this system may be affixed to the rear base beam 55 and may be concealed by an enclosure or housing 85 similar to the one containing the winch as described above. The motorized drive system may be powered by a reversible electric motor 85A which may be contained within the housing 85 that may also contain a gear reduction drive 85B. Two drive shafts 86 may extend horizontally from opposite sides of the housing 85 and each may be connected through a universal coupling 87 to a propelling axle 88 which may cooperate with a sprocket wheel 89. A three piece iron support system 90 situated on each end of the rear base beam 55 may support the propelling axles 88 and this unique system may also support the sprocket wheels 89 in such a manner that drag may be minimized and the maximum of the energy expended may be utilized to move the building. The two support systems 90 may be set up as mirror images of each other. One such system may be described below.

Figure 31:
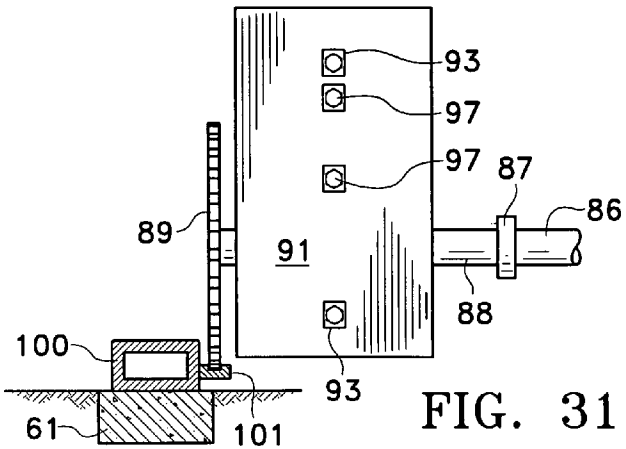
FIG. 31 is a rear view of the support system and sprocket wheel.
Figure 29:
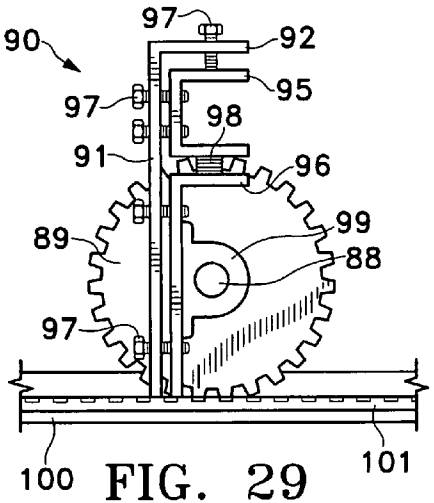
FIG. 29 is a side view of the support system for the sprocket wheel.
Figure 32:
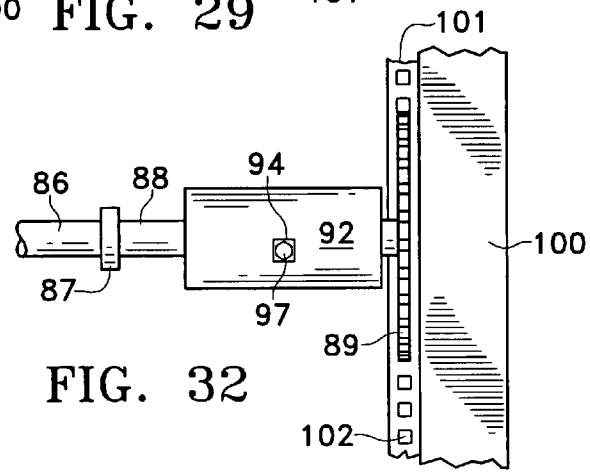
FIG. 32 is a top view of the support system and sprocket wheel.

The main part of the support system 90 may be an iron planar vertical rear support 91 that may have an upper horizontal extension 92 such that when viewed from the side it may appear as an inverted L-shape as may be seen in FIG. 29. The bottom of a rear vertical support 91 may be affixed to each end of the rear base beam 55 and the motor housing 85 may be affixed at the center of the rear base beam 55. It may be preferable to make these attachments by welding. There may be four vertically aligned slots 93 along the center line of the rear vertical support 91 (FIGS. 30 and 31) and one slot 94 in the upper horizontal extension 92 (FIG. 32). The support system 90 may include a U-shaped iron support 95 and a shorter inverted L-shaped iron support 96, one aligned below the other, under the horizontal extension 92. These shapes describe the supports as viewed from the side as seen in FIG. 29. The U-shaped support 95 may have an upper extension, a lower extension and a back portion. The U-shaped support 95 may be connected to the vertical support 91 using two bolts 97 which extend through the two upper slots 93 in the rear vertical support 91 and two corresponding slots in the back portion of the U-shaped support. A third bolt 97 may extend though the slot 94 in the upper horizontal extension 92 and a corresponding slot in the upper extension of the U-shaped support, as may be seen in FIG. 29. The smaller L-shaped support may be connected to the vertical support 91 using two bolts 97 which may extend through the two lowermost slots 93 in the rear vertical support 91 and two corresponding slots in the vertical portion of the smaller L-shaped support. The U-shaped support 95 and the smaller L-shaped support 96 may be connected to each other by a coil spring 98 which may be attached to the underside of the lower extension of the U-shaped support 95 and the top of the horizontal portion of the smaller L-shaped support 96. The attachments may be by welding or other means known in the art. The U-shaped support 95 and smaller L-shaped support 96 may not be affixed to any other stationary structure and may therefore be suspended and free to move vertically within the confines of the slots 93 and 94 since the bolts 97 holding them extend through these slots 93 and 94 in a slidable manner to make a degree of movement possible.

Figure 30:
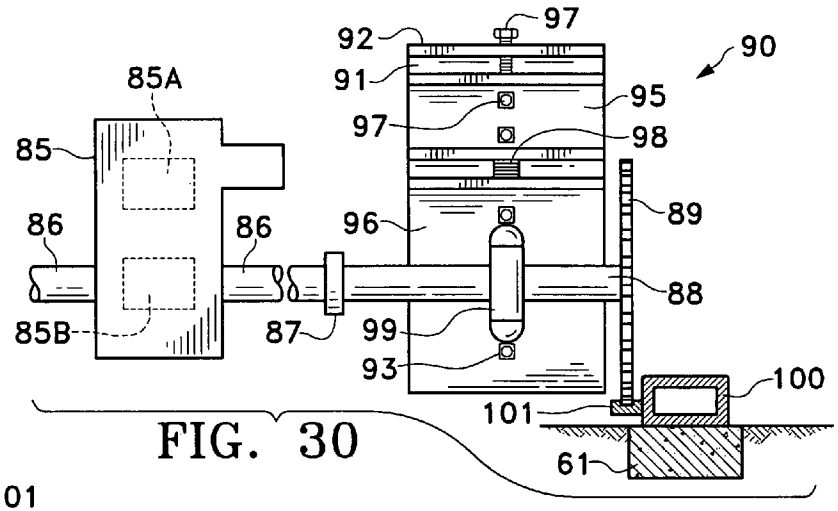
FIG. 30 is a front view of the support system for the sprocket wheel and the motor housing.

The propelling axle 88 may be supported by an iron bracket 99 that may be affixed to the front surface of the vertical portion of the smaller L-shaped support 96 as seen in FIGS. 29 and 30. This bracket 99 may be similar in structure to the iron brackets 65 used to hold the roller assemblies in place on the underside of the longitudinal base beams 42. Though the primary support for the entire support system 90 may come from the vertical support 91 which is permanently affixed to the rear base beam 55, the propelling axle 88 and sprocket wheel 89 may be supported by the bracket 99 but allowed a degree of vertical movement, as noted above, due to the coil spring 88 and bolts 97 and slot 93 and 94 supporting means. This degree of vertical movement may prevent drag on the sprocket wheel 89 and greatly minimize damage to the sprocket wheel and the drive system when the building 40 is being moved.

Figure 26:
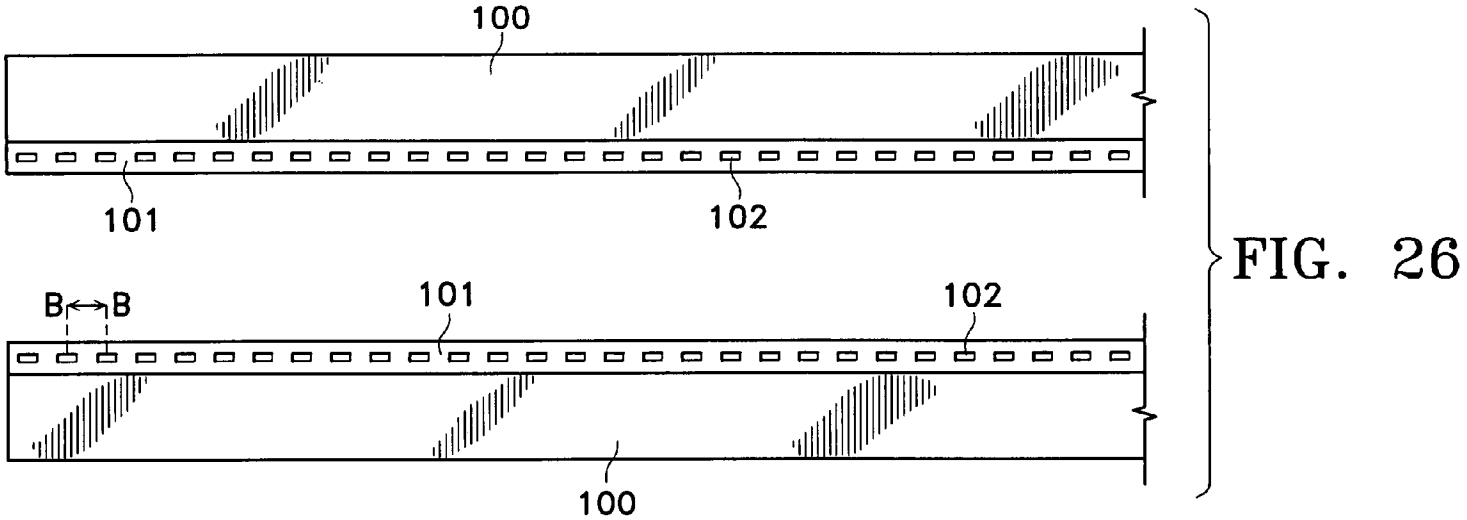
FIG. 26 is a top plan view of the rails modified to accept the second means of moving the building.
Figure 27:
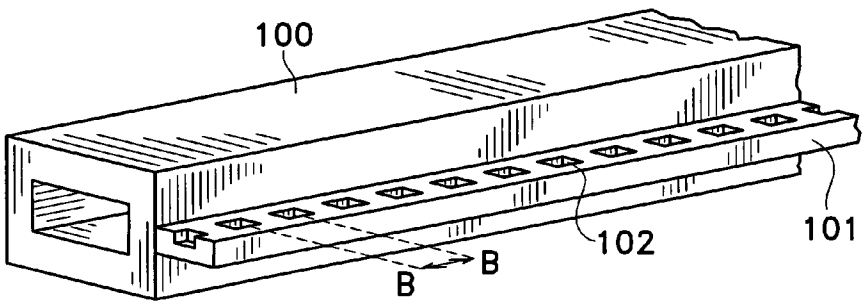
FIG. 27 is a front perspective view of a portion of the modified rail.
Figure 28:
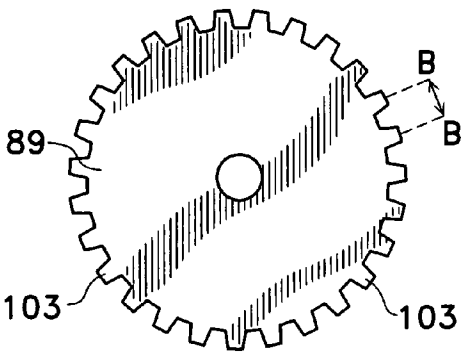
FIG. 28 is a plan view of the sprocket wheel.

To provide an interactive track for the sprocket wheel 89 to traverse, the initial rails set down for the movable building 40 may be modified. The modified rails 100 may be channel iron, as previously described, with the addition of a slotted iron track 101 welded to substantially the midlevel of the inside wall of each rail 100. The slots 102 in the tracks 101 may be sized and spaced to correspond to the sizing and spacing of the teeth 103 of the sprocket wheel 89. This spacing may denoted as B-B in FIGS. 26, 27 and 28. The interaction of the sprocket wheel 89 with the slotted track 101 may be seen in FIGS. 29 through 32. When the moving system is activated, the two sprocket wheels 89 may rotate in unison and may propel the movable building 40 in the desired direction along the rails 100. Though the sprocket wheels 89 may be no more than 12 inches (30.5 cm) in diameter, the gear reduction system in conjunction with the reversible motor may provide sufficient power to enable the building 40 to move smoothly along the rails 100 as needed, both in the forward and reverse directions. The sprocket wheels 89 may be situated such that they lie within the triangular space defined by the lower short cross supports 52, the rear base beam 55 and each longitudinal base beam 42. These structures may be covered by housings built into the interior corners of the completed building.

To enable the building 40 to be moved with ease it may be important that there be no impediments to the movement such as grass or other plant life. There may not be any ground faults or stones in the area of the rails. Additionally, though the footings may lie at or below ground level, the rails must be above ground level. The brackets and roller systems on the undersides of the longitudinal base beams 42 of the movable building may be slightly above ground level leaving some open space along the bottom of the side wall enclosures which may not be very significant in summer when the building may stand alone and open, but which may become troublesome in winter when the building abuts another structure and functions to provide a secure enclosure. The space beneath the building may also enable rain water and melting snow to enter the enclosure. Additionally, there may be no rail along the rear wall so that there may be a considerable open area between the bottom of the rear base beam 55 (rear wall) and the ground. To seal these open spaces, hinged panels 106 may be used.

As noted above, the special channel iron used for the base beams 42 has two horizontal extensions 43. The lower extensions may be used to connect the iron brackets 65 of the roller assemblies and wobble supports 70 to the longitudinal base beams 42. The upper extensions 43 may serve as supports and attachment means for wooden beams 105 laid, horizontally on and affixed to the longitudinal and rear base beams 42 and 55 along both the inside and outside of the three walls of the movable building 40. These wood beams 105 may provide a surface for the attachment of a series of hinged panels 106 which may run the entire length of the inside and outside of the two side walls and the rear wall. The hinges 107 used to attach the panels to the wood beams 105 may permit the panels 106 to rotate a full 180° so that they may be fastened in the upright position during the moving of the building to insure that the panels 106 may not be damaged during the moving operation. When the panels 106 are let down they may lie adjacent to the ground and may act as sealing means along the bottom of the walls both on the interior and exterior of the building. The panels 106 may also conceal the roller assemblies and wobble supports both for aesthetic reasons and safety reasons. See FIGS. 20 and 21.

Figure 1:
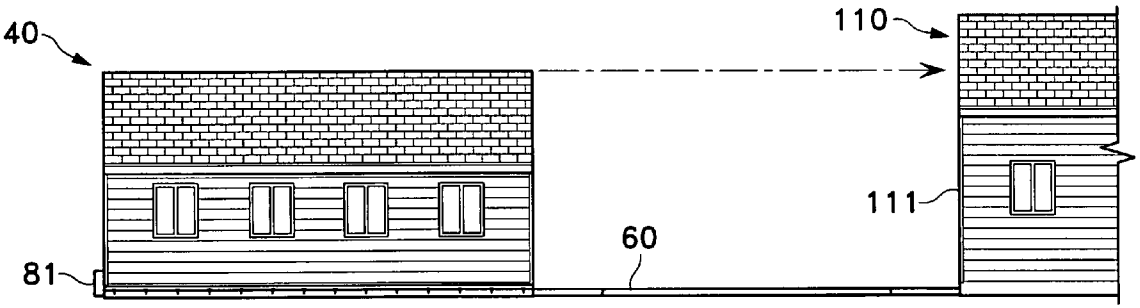
FIG. 1 is a side view of the movable building and a portion of a permanent structure, completely separated.
Figure 2:
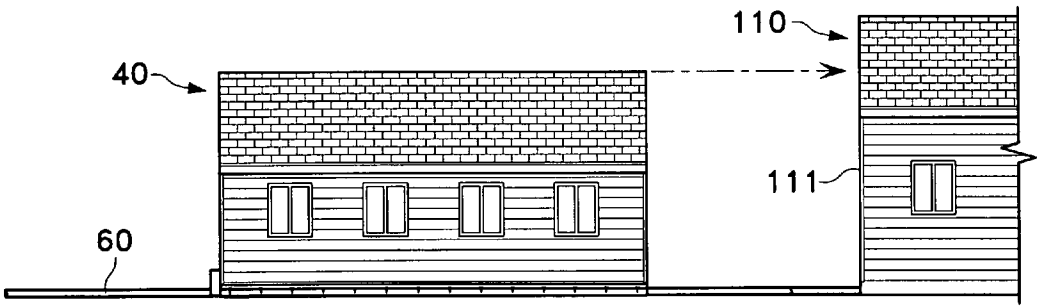
FIG. 2 is a side view of the movable building partially moved toward the permanent structure.
Figure 3:
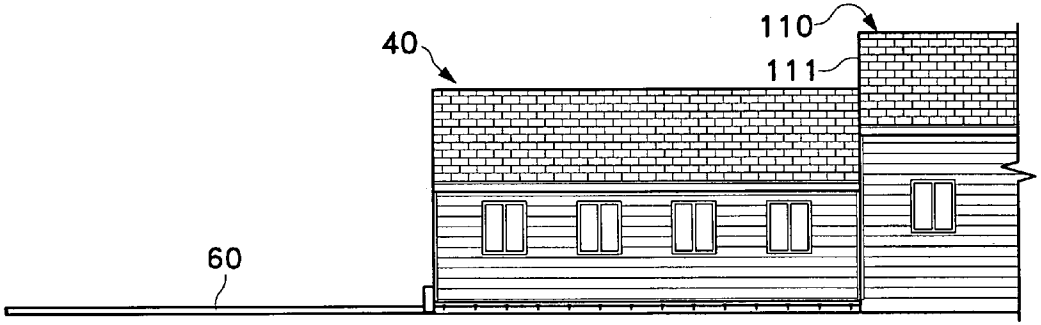
FIG. 3 is a side view of the movable building in contact with the permanent structure.
Figures 4, 5, 6:
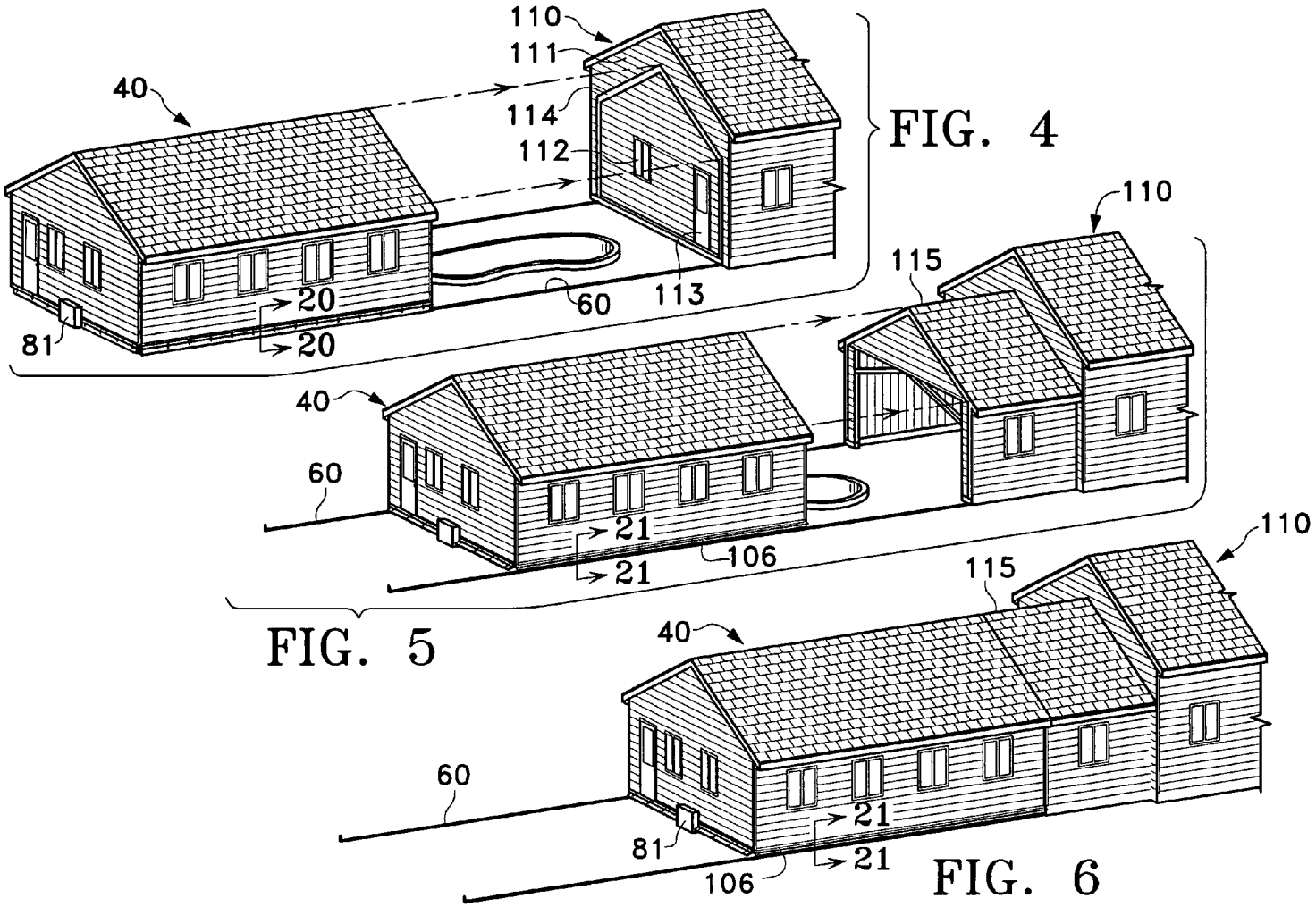
FIG. 4 is a perspective view of the movable building completely separated from the permanent structure as seen in FIG. 1.
FIG. 5 is a perspective view of the movable building partially moved toward a permanent structure having an extension dimensioned to cooperate with the movable structure.
FIG. 6 is a rear perspective view of the movable building in contact with the permanent structure of FIG. 5.

FIG. 4 may show the side wall panels in their downward or closed orientation and FIGS. 5 and 6 may show the side wall panels in their raised orientation. Hooks (not illustrated) or other means may be used to keep the panels 106 raised when the building is moved. The panels 106 may be constructed of plywood or other rigid material. There may be insulation materials such as 2 inch (5 cm) thick foam insulation affixed to the inside surfaces of the panels 106 (not illustrated). After the building has been moved and fixed in place the panels 106 may be lowered and may provide a weather-proof barrier to insure that the closed building can be heated as necessary during the colder months.

As described in detail above, the movable building 40 may have three walls, a roof and no floor and it may also have one completely exposed side. The purpose of moving this building 40 may be to bring it up to an abutting structure which may serve to close off the exposed side, complete the building, seal it against the elements, and provide an enclosure for what was an outdoor area. It may be advantageous to have at least one door 113 in the movable structure 40 for entrance and exit once the movable building 40 has been moved to abut another structure. Suitably placed windows 112 may provide light and ventilation.

The abutting structure may take a variety of forms which may not be limited to those described herein. One form may be seen in FIGS. 1, 2, 3 and 4. In this example, the rails 60 for the movable building 40 may be constructed to extend directly up to an exterior substantially flat wall 111 of an existing structure 110. This wall 111 may or may not contain one or more windows 112, but it may be advantageous that there be a door 113 in the wall and that the door 113 lie within the area defined by the outline where the movable building 40 abuts the existing structure 110. The door 113 may provide access from the existing structure 110 to the interior of the movable building 40 when the two have been joined together. It may also be advantageous to provide a sealing means 114 on the wall 111 all around the area where the movable building 40 abuts the wall 111 so that the interior of the movable building 40 may be completely closed off from the elements and may be able to be heated if desired. There may also be sealing means 114 around the perimeter of the open end of the movable building 40.

A second form for the abutting structure may be an extension 115 built out from a wall of an existing structure. In this example the extension 115 may be constructed such that the side edges and roof line correspond to those of the movable building 40 so that when the two are joined they appear as one long extension as may be seen in FIGS. 5 and 6. In this example, the roof line and side edges may have sealing means 114 applied so the combined structure is tightly closed at the juncture. There may also be sealing means 114 along the roof line and side edges of the movable building 40 to aid in the sealing it to the abutting structure. See FIG. 9. The abutting structure may also be an extension off a main structure that is larger than the open side of the movable building. In this case there may be an opening in the side of the extension sized to correspond to the open side of the movable building. This type of extension is not illustrated.

Figure 7:
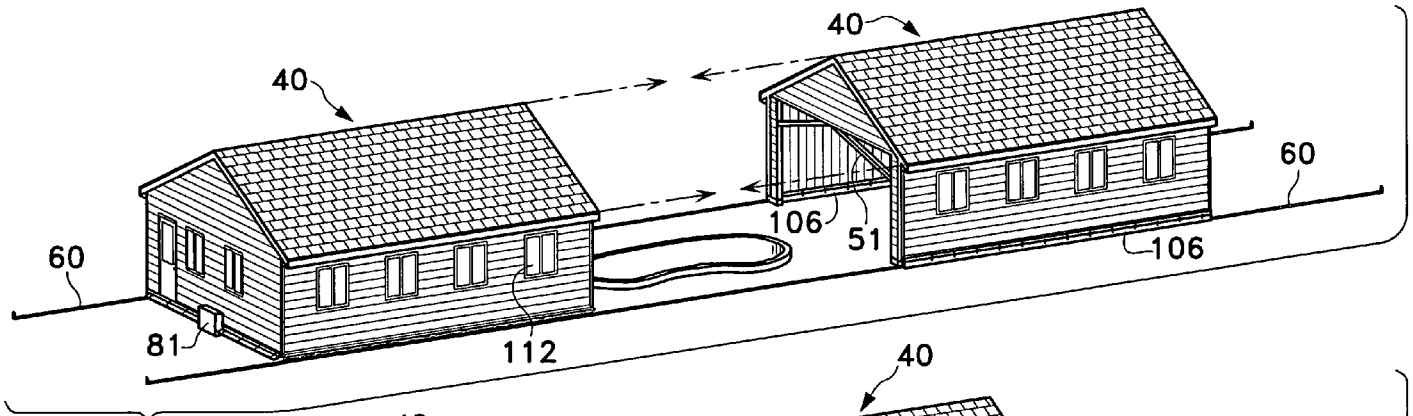
FIG. 7 is a perspective view of two movable buildings partially moved toward each other.
Figure 8:
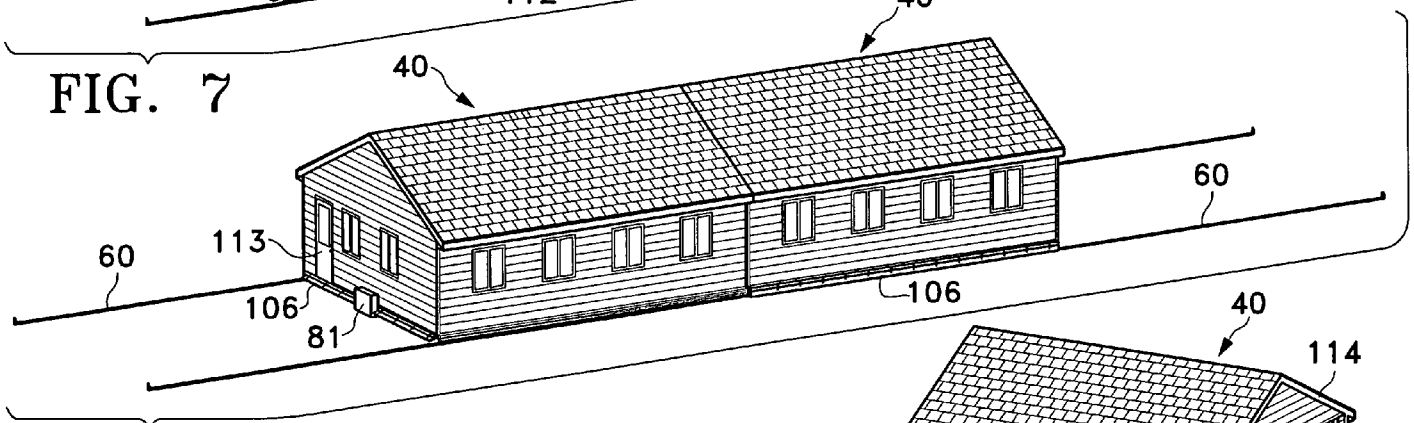
FIG. 8 is a perspective view of the two movable buildings of FIG. 7 in contact.
Figure 9:
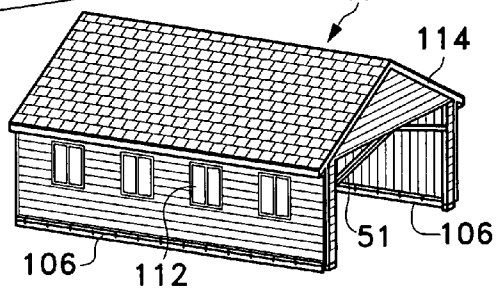
FIG. 9 is a front perspective view of the movable building.

For one reason or another it may not be possible or practical for a movable building to be constructed to abut an existing structure. This may be due to uneven terrain, the amount of land needed, or a variety of other reasons. When an existing structure is not a choice, a simple free standing wall (not illustrated) may be erected as the abutting structure. Another solution may be to have two movable buildings 40 constructed on a single rail system so that they may be moved together to form one structure enclosing a given area. The two movable buildings may be of the same dimensions, or they may have different lengths. If a single rail system is to be used, the widths of the two movable buildings must be the same. As seen in FIGS. 7 and 8, when two movable buildings are used, the rail system may be at least twice the length of the combined length of the two buildings and may be erected on a completely flat area.

FIGS. 4, 5 and 7 depict movable buildings 40 that may enclose a swimming pool. This may be one very good use of the instant invention. However, it may only represent one of many uses. The movable building of the instant invention may be utilized by both the home owner and the owner of a commercial property or business. It is a practical solution for any area that is used as an outdoor facility in good weather and cannot be used during winter in colder climates or during inclement weather even in warm climates. Rain can make an otherwise useful outdoor area off limits even when the temperature is totally acceptable. The ability to enclose such an area in merely minutes can greatly enhance its usefulness. In warm climates, many restaurants utilize outdoor areas for patio dining. Such areas cannot be used when it rains often resulting in a loss of business that would otherwise have been possible. The ability to bring the patio "inside" may enable the restaurant to serve many more patrons. These suggestions may merely touch on the many uses for the instant invention.

A typical size for the movable building may be 30 feet (9 m) long and 24 feet (7.2 m) wide. The rails may be at least 60 feet (18 m) long and the distance between the rails may be 24 feet (7.2 m). The rollers may be spaced every two feet (0.6 m) along the two longitudinal base beams. In general, the number of rollers used may depend upon the size and weight of the building. The number and placement of the wobble supports may also depend upon the dimensions of the building.

Typical sealing means between the building and the abutting structure may consist of foam padding used with other sealant materials.

While one embodiment of the present invention has been illustrated and described in detail, it is to be understood that this invention is not limited thereto and may be otherwise practiced within the scope of the following claims.

I claim:

1. A free standing movable building comprising:

a rigid framework comprising iron members permanently and securely affixed one to the other to form a strong, stable and rigid infrastructure functioning as a single unit and remaining intact when the building is moved, the iron members including two opposing longitudinal base beams and one rear transverse base beam forming a U-shaped foundation for said movable building and providing a low center of gravity and stability therefor, two front vertical support beams affixed to the front end of each longitudinal base beam, two rear vertical support beams affixed to the rear end of each longitudinal base beam, an upper horizontal beam affixed to the tops of the two front vertical support beams, and an upper horizontal beam affixed to the tops of the two rear vertical support beams;

three contiguous walls including a rear wall and two side walls, and a roof built over the rigid framework, an open front portion and no floor; and a plurality of opposing pairs of roller assemblies to move the building from a first location to a second location, said roller assemblies affixed to the undersides of the longitudinal base beams of the rigid framework.

2. A free standing movable building as described in claim 1 wherein the rigid framework further comprises long cross supports extending downwardly from the top of each vertical support beam to the adjacent longitudinal base beam and short cross supports at the rear lower corners and at the upper corners.

3. A structural assembly for reversibly enclosing an outdoor ground area comprising:

a free standing movable building configured to be moved in its entirety from a first location adjacent the outdoor ground area to a second location enclosing the outdoor ground area, said building having three contiguous walls, in the form of two side walls and a rear wall, an open side being the forward portion of the building, a roof and there being no floor;

parallel rail assemblies, set on the ground on either side of the outdoor ground area, on which the building moves;

means to roll and propel the building over said parallel rails from said first location in a forward direction to enclose the outdoor ground area and from said second location in a rearward direction to expose the outdoor ground area; and an abutting structure against which the building is moved to completely enclose the outdoor ground area and to cover the open side of said building.

4. A structural assembly for reversibly enclosing an outdoor ground area comprising:

a free standing movable building configured to be moved in its entirety from a first location adjacent the outdoor ground area to a second location enclosing the outdoor ground area, said building having three contiguous walls in the form of a rear wall and two side walls, an open side being the forward portion of the building, a roof and there being no floor, said building having a rigid framework;

a plurality of rotatable solid axle roller assemblies affixed to the undersides of the rigid framework enabling said building to move from the first location in a forward direction and from the second location in a rearward direction;

parallel rail assemblies, set on the ground on either side of the outdoor ground area, on which the building moves;

propelling means to propel the building on the rail assemblies; and an abutting structure against which the building is moved to enclose the outdoor ground area and to cover the open side of said building.

5. A structural assembly as described in claim 4 wherein the building further comprises at least one window and at least one door.

6. A structural assembly as described in claim 4 wherein the rigid framework comprises iron members permanently and securely affixed one to the other to form a strong, stable and rigid infrastructure functioning as a single unit and remaining intact when the building is moved.

7. A structural assembly as described in claim 6 wherein the iron members include two opposing longitudinal base beams and one rear transverse base beam forming a U-shaped foundation for said movable building and providing a low center of gravity and stability therefor.

8. A structural assembly as described in claim 7 wherein the base beams are composed of channel iron configured to accept vertical studs used in the construction of the walls of the building and to provide attachment sites for the roller assemblies and support surfaces for upper structures.

9. A structural assembly as described in claim 7 wherein the roller assemblies are arranged in opposing pairs disposed along the undersides of two longitudinal base beams of the rigid framework and securely affixed thereto.

10. A structural assembly as described in claim 7 wherein the iron members further comprise two front vertical support beams affixed to the front end of each longitudinal base beam, two rear vertical support beams affixed to the tear end of each longitudinal base beam, an upper horizontal beam affixed to the tops of the two front vertical support beams, an upper horizontal beam affixed to the tops of the two rear vertical support beams, long cross supports extending downwardly from the top of each vertical support beams to the adjacent longitudinal base beam and short cross supports at the rear lower corners and at the upper corners.

11. A structural assembly as described in claim 7 wherein the parallel rail assemblies comprise two continuous parallel concrete footings set into the ground and two continuous parallel iron rails disposed thereon, and means to securely and permanently attach said rails to said footings, said footings and said rails being at least twice the length of the two opposing longitudinal base beams of the movable building.

12. A structural assembly as described in claim 11 wherein the parallel concrete footings and parallel iron rails are set the same width apart as the two opposing longitudinal base beams of the movable building.

13. A structural assembly as described in claim 11 wherein the iron rails are composed of a plurality of lengths of hollow channel iron having an upper horizontal surface, a lower horizontal surface and two vertical side surfaces, permanently and smoothly affixed one to the other to form the two continuous rails.

14. A structural assembly as described in claim 13 wherein the means to securely attach the rails to the footings comprises apertures drilled into the rails through the upper horizontal surface and the lower horizontal surface and anchor bolts introduced through the apertures into the concrete footings, said apertures and said anchor bolts being arranged in pairs evenly spaced along the full lengths of the rails.

15. A structural assembly as described in claim 14 further comprising means to close the apertures and provide a smooth and uninterrupted upper horizontal surface on which the building moves.

16. A structural assembly as described in claim 11 further comprising a plurality of stabilizing means situated on each side of the movable building to prevent the building from wobbling or becoming dislodged from the rails when being moved.

17. A structural assembly as described in claim 16 wherein each of said stabilizing means comprises a support affixed to the underside of the longitudinal base beam and extending across the rail and two horizontally mounted rotatable wheels, one attached to each end of the support, such that one wheel is disposed adjacent to each vertical side surface of the rail and rotates as the building moves.

18. A structural assembly as described in claim 13 further comprising at least one locking means to prevent the building from movement once it has been moved to the first location and to the second location, said locking means making secure contact between the rigid framework of the building and the rail assemblies.

19. A structural assembly as described in claim 18 wherein the at least one locking means comprises a hollow tube permanently affixed to the underside of the rigid framework, said hollow tube positioned such that the open end faces outward; two sets of openings in the vertical side surfaces of the hollow channel iron rails positioned such that one set of the openings lies beneath the hollow tube when the building is in the first location and the other set of openings lies beneath the hollow tube when the building is in the second location; and a lock in the form of a rigid plate having two dowels projecting from one surface, said dowels positioned so that one dowel fits into the hollow tube and the other dowel fits into one of the sets of openings in the rail when the building has been moved to the desired location, whereby when the two dowels of the lock have be inserted, one into the hollow tube and the other into one of the sets of openings in the rail, the building cannot be moved.

20. A structural assembly as described in claim 4 wherein the rotatable solid axle roller assemblies comprise:

a solid axle extended between two axle supports, said axle supports having bearings to permit the axle to rotate; and two brackets, each receiving one of the axle supports, said brackets being affixed to the underside of the rigid framework and positioned such that the axle extends across the rail assembly and is in contact therewith.

21. A structural assembly as described in claim 4 further comprising at least one rear stabilizing means to prevent the building from lateral movement or wobble when the building is in the first location, said at least one stabilizing means comprising a rigid upright stanchion affixed to the rear end of the rail assembly and an L-shaped locking member attached to the surface of the upright stanchion facing the building and set at a height such that the L-shaped locking member fits within a rear bottom portion of the rigid framework, whereby when the L-shaped locking member is in communication with the rear bottom portion of the rigid framework the building is prevented from lateral movement or wobble.

22. A structural assembly as described in claim 4 wherein the propelling means comprises;

a winch including a rotatable drum, said winch being fixedly attached to the lower rear end of the rigid framework;

a cable affixed at one end to the drum and at the other end to an attaching means;

two in-ground attachment points, one disposed at a point between the rails at a forward end of the rails and one disposed at a point between the rails at a rearward end of the rails; and means to activate the winch and rotate the drum;

whereby when the cable is stretched out so that the attaching means cooperates with the attachment point at the forward end of the rail assemblies and the winch is activated the cable is wound around the drum in a first direction and the building is moved from the first location to the second location adjacent the abutting structure and enclosing the outdoor ground area and when the cable is stretched out in the opposite direction so that the attaching means cooperates with the attachment point at the rearward end of the rails and the winch is activated the cable is wound around the drum in a second direction and the building is moved from the second location to the first location away from the abutting structure and adjacent to the outdoor ground area.

23. A structural assembly as described in claim 4 further comprising a series of adjacent hinged panels disposed along the lower portion of the inside and outside of the three contiguous walls of the movable building and being rotatable to an upright orientation, said hinged panels to conceal the roller assemblies and to close any space between the building and the ground when the building is in the first location and when the building is in the second location.

24. A structural assembly as described in claim 23 further comprising holding means to maintain the hinged panels in the upright orientation when the movable building is being moved.

25. A structural assembly as described in claim 4 wherein the open side of the movable building includes flat vertical edges forming its perimeter.

26. A structural assembly as described in claim 25 wherein the abutting structure comprises a stationary wall that is at least the height and width of the open side of the movable building such that the flat vertical edges of the open side of the movable building abut the surface of the stationary wall facing the movable building when the movable building is in the second location.

27. A structural assembly as described in claim 26 wherein the stationary, wall is an exterior wall of an existing stationary structure.

28. A structural assembly as described in claim 25 wherein the abutting structure comprises a stationary structure with an open side corresponding in height and width to the open side of the movable building and having flat vertical edges around the perimeter of the open side such that when the movable building abuts the stationary building and the two are joined together the flat vertical edges of the perimeters of the open sides of both buildings cooperate and the resulting enclosure is larger then the enclosure created by the movable building alone.

29. A structural assembly as described in claim 25 wherein the abutting structure comprises a second free standing movable building having three walls, two side walls and a rear wall, a roof, an open front portion having flat vertical edges around its perimeter and no floor such that the two free standing movable buildings can be moved toward each other and the open front portions of both buildings abut each other and cooperate to enclose an outdoor area the size of the two free standing movable buildings in combination.

30. A structural assembly as described in claim 25 further comprising scaling means applied to the flat vertical edges of the perimeter of the open portion of the movable building to seal a point of juncture between said flat vertical edges of the movable building and a flat vertical surface of the abutting structure so that the resulting enclosure is weather proof.

* * * * *